US009427760B2

(12) United States Patent
Chiu

(10) Patent No.: US 9,427,760 B2
(45) Date of Patent: Aug. 30, 2016

(54) LED-ILLUMINATED WATER SPRAYING GUN

(71) Applicant: Shih-Feng Chiu, Changhua (TW)

(72) Inventor: Shih-Feng Chiu, Changhua (TW)

( * ) Notice: Subject to any disclaimer, the term of this patent is extended or adjusted under 35 U.S.C. 154(b) by 11 days.

(21) Appl. No.: 14/571,153

(22) Filed: Dec. 15, 2014

(65) Prior Publication Data

US 2016/0167070 A1 Jun. 16, 2016

(51) Int. Cl.

| | |
|---|---|
| ***B05B 1/26*** | (2006.01) |
| ***B05B 1/30*** | (2006.01) |
| ***B05B 9/01*** | (2006.01) |
| ***B05B 15/00*** | (2006.01) |
| ***F21L 13/06*** | (2006.01) |
| ***F21V 33/00*** | (2006.01) |
| *F21Y 101/02* | (2006.01) |

(52) U.S. Cl.

CPC ..... *B05B 9/01* (2013.01); *B05B 1/265* (2013.01); *F21L 13/06* (2013.01); *F21V 33/00* (2013.01); *F21Y 2101/02* (2013.01)

(58) Field of Classification Search

CPC ..... B05B 1/262; B05B 1/265; B05B 1/3073; B05B 9/01; B05B 15/00; F21L 13/06; F21V 33/00; F21Y 2101/02

USPC ..... 239/289, 451, 456–458, 525, 526, 539, 239/541, 587.1, 587.5, 587.6; 362/192, 253

See application file for complete search history.

(56) References Cited

U.S. PATENT DOCUMENTS

| | | | | |
|---|---|---|---|---|
| 4,564,889 | A * | 1/1986 | Bolson | F21S 8/00 290/54 |
| 4,616,298 | A * | 10/1986 | Bolson | A62C 37/08 290/54 |
| 6,511,001 | B1 * | 1/2003 | Huang | B05B 15/066 239/526 |
| 6,592,057 | B1 * | 7/2003 | Ericksen | B05B 1/3073 239/525 |
| 6,702,206 | B2 * | 3/2004 | Wu | B05B 1/3026 239/525 |
| 7,000,855 | B1 * | 2/2006 | Chen | B05B 1/3066 239/456 |
| 7,607,789 | B2 * | 10/2009 | Lu | F21V 33/004 239/18 |
| 7,611,074 | B2 * | 11/2009 | Chen | B05B 9/01 239/525 |
| 2003/0147238 | A1 * | 8/2003 | Allen | F03B 13/00 362/192 |
| 2005/0237742 | A1 * | 10/2005 | Wang | B05B 15/00 362/253 |
| 2008/0225517 | A1 * | 9/2008 | Clark | B05B 1/185 362/192 |
| 2009/0247043 | A1 * | 10/2009 | Liao | B05B 15/00 446/405 |
| 2013/0015271 | A1 * | 1/2013 | Chen | B05B 1/06 239/526 |

* cited by examiner

*Primary Examiner* — Darren W Gorman

(74) *Attorney, Agent, or Firm* — Che-Yang Chen; Law Offices of Scott Warmuth

(57) ABSTRACT

An LED-illuminated water spraying gun may include a water spraying gun, a fixed sleeve, a nozzle, an illumination device and a movable sleeve, which the nozzle has assembly hole to set the LED lamp on, and set power generating device on holding chamber. It can let the power generating device's rotary disc on shaft can be rotated by water flow, and let the LED lamp can generate illumination at movable sleeve's guide ring, which movable sleeve's forth thread lock on nozzle's third thread, it makes water flow can flow through from nozzle's side hole to movable sleeve's through hole, and can adjust the hole to spray the water. The movable sleeve can move and make adjusting hole move between nozzle's ring part and tapered part, which can change the spray and the move will not influence the LED lamp.

5 Claims, 12 Drawing Sheets

LED-ILLUMINATED WATER SPRAYING GUN

FIELD OF THE INVENTION

The present invention is related to an LED-illuminated water spraying gun.

BACKGROUND OF THE INVENTION

Referring to FIGS. 12-13, an LED-illuminated water spraying gun 70 may have a water spraying gun body 71, which this water spraying gun body 71 connects to semi-circular cover 73 at transverse water outlet pipe 72, it can makes water flow can flow out from semi-circular cover's 73 front porous ring 731, and set an inter-connective illumination device 74 and electric device 75 inside the semi-circular cover 73. The axial direction of the bottom of semi-circular cover 73 has a tubular holding chamber 732, between the outside of tubular holding chamber 732 and the bottom of inner cover 73 have multiple perforated holes, it can make water flow inside cover 73, and the front of the cover 73 has an outer cover 734, the illumination device 74 can connect on the front of the tubular holding chamber 732, It includes a base 742 with light 741, which are connected by lights 741 wire 743, a light's 741 frosted glass diffuser 744 and light cover 745, which the light cover 745 inter-locks with base 742, and the electric device 75 sets inside tubular holding chamber 732, which includes a alternator 751, a side connects with circuit board 752 to provide connection with two wires 753, the other side has a drift shaft 754 extend to bottom of tubular holding chamber 732 and connect to fan disc 76. The fan disc 76 has multiple cambered blades 761 around the disc, and the fan disc 76 is covered by water inlet disc 77, which water inlet disc 77 has plurality water outlets 771, water outlets 771 aligns to fan disc's 76 blades 761, when the water flow out from water outlets 771, it can flow to cambered blades 761 of electric device's 75 fan disc 75, and drive the fan disc 76 rotate and generate electricity for illumination device 74, and then the water will flow out from open end of blades 761, pass through perforated hole 733 to cover 73 inside, and flow out to porous ring 731 and spray.

According to above-mentioned structure, there are still some problems that need to be solved: (1) the water spraying gun 70 only has illumination device 74 and electric device 75, but no adjusting spray function, the function of the water spraying gun 70 is too simple and less practicability; (2) the water flow of water spraying gun 70 flows out from water inlet disc's water outlet and rushes to fan disc 76 directly, however, the water does not rush front side of blades 761, it makes the force of water flow disperse and eliminate, which cannot drive fan disc 70 to rotate effectively and make alternator 751 generate electricity unstably, it will makes the light 741 shines unstable; and (3) the water spraying gun 70 does not have the function of adjusting elevation angle of spray, which is too simple and does not provide enough functions.

Therefore, there remains a need for a new and improved LED-illuminated water spraying gun to overcome the problems stated above.

SUMMARY OF THE PRESENT INVENTION

To solve the problems stated above, the present invention provides an LED-illuminated water spraying gun that includes a handle, which the handle has a press button, and one side of the handle is connected to coupling sleeve by a wheel, the coupling sleeve has a water outlet hole in the middle, pressing button can adjust water spray from water outlet hole. A fixed sleeve has a deflector set on one side, which the deflector has plurality assembly convex parts with opposite direction, and setting a deflector hole between two assembly convex parts, and then the on the other side of fixed sleeve has first thread inside. A nozzle has a holding chamber inside on the one side and the outer of nozzle at holding chamber generates one second thread and one third thread, and then second thread fix with fixed sleeve's first thread, and then the other side of nozzle has assembly hole inside, which has a external expanding ring, and the nozzle forms a cone toward ring part's tapered part, and then the nozzle has a channel between holding chamber and assembly hole, and the nozzle transversely runs through channel and form a side hole. A illumination device is connected with a LED lamp and a power generating device by wire, and extended by power generating device has a shaft, which the LED lamp runs through and sets on nozzle's assembly hole, and sets power generating device into nozzle's holding chamber, which the power generating device forms two planar parts, utilizing planar parts' shrinking can make water flow through between holding chamber and alternator, and then the shaft extends to inside of the fixed sleeve and connected to rotary disc by shaft, which the rotary disc forms radially plurality blades outside. A movable sleeve has a through hole axially runs through, one inner side of through hole forms a fourth thread, the movable sleeve is set on nozzle and set on nozzle's third thread by fourth thread, it makes nozzle's side hole and movable sleeve's through hole connected, and the movable sleeve forms a expanding guide ring on the other side of the through hole, the guide ring forms a adjusting hole, which its diameter is shorter than through hole, the adjusting hole is between nozzle's ring part and tapered part.

The first objective of the present invention is that the nozzle has assembly hole to set LED lamp on, and set power generating device on holding chamber. It can let the power generating device's rotary disc on shaft can be rotated by water flow, and let LED lamp can generate illumination at movable sleeve's guide ring, which movable sleeve's fourth thread lock on nozzle's third thread, it makes water flow can flow through from nozzle's side hole to movable sleeve's through hole, and utilizing adjusting hole to spray the water. The movable sleeve can move and make adjusting hole move between nozzle's ring part and tapered part, which can change the water spray and the movement will not influence LED lamp, moreover, it has LED lamp illumination and changing water spray function, and enhance practicability.

The second objective of the present invention is that the deflector has plurality assembly convex parts with opposite direction, and setting a deflector hole between two assembly convex parts. When the water flow from deflector hole to deflector, deflector hole is placed diagonally and water is affected by space of convex part, it can makes water rushes to the front of the rotary disc's blade and enhances driving force applying to rotary disc, which can increase rotary speed and torsion of rotary disc and enhance the stability of generating electricity.

The third main purpose of the present invention is that the wheel has fixed disc and movable disc, which movable disc is set on fixed disc's circular hole by screw, it makes movable disc's perforated hole connect to coupling sleeve's water outlet hole, and the movable disc can rotate around screw, moreover, it can change the relative angle between coupling sleeve and water spraying gun, thereby, it has the function of adjusting elevation angle of water spray.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristic and effect of the present invention, a number of embodiments along with the drawings are illustrated as following.

Figure 1:
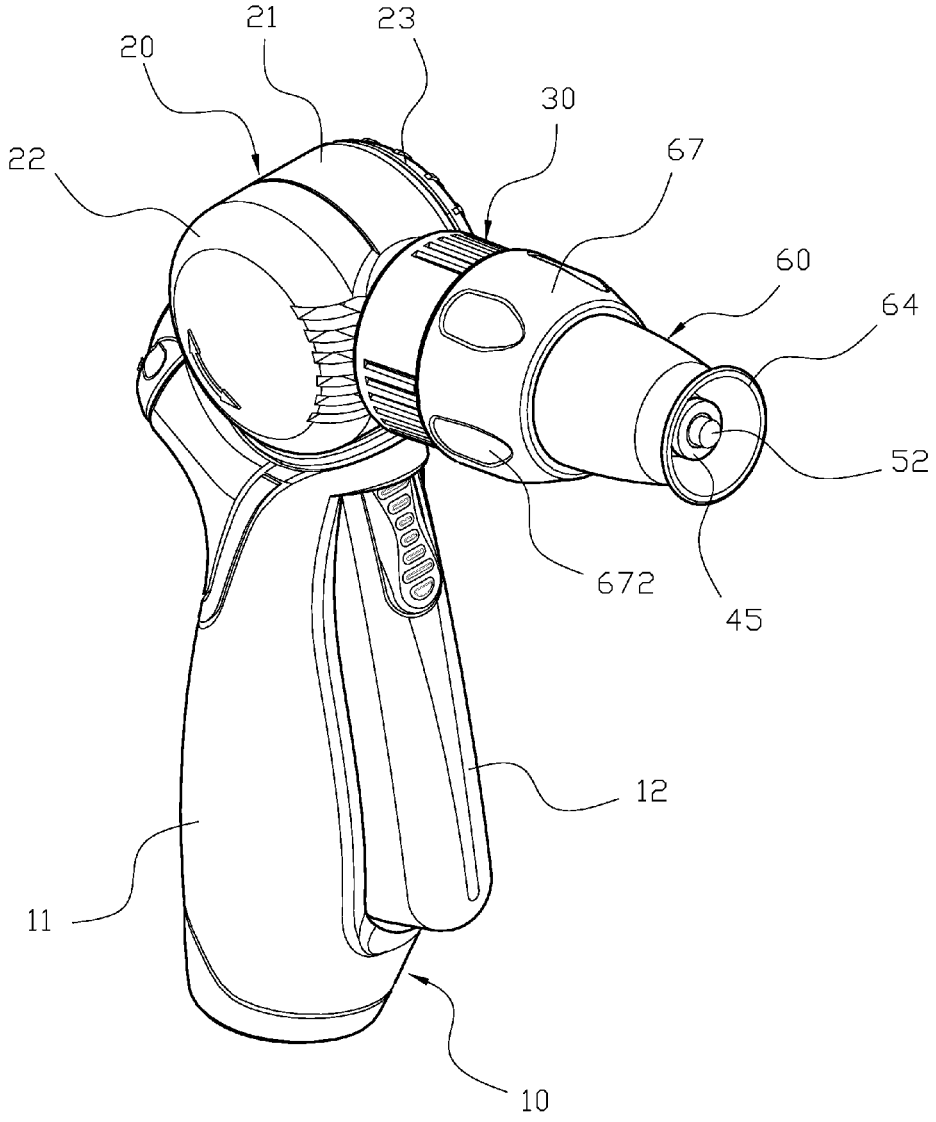
FIG. 1 illustrates a three-dimensional view of the present invention.
Figure 2:
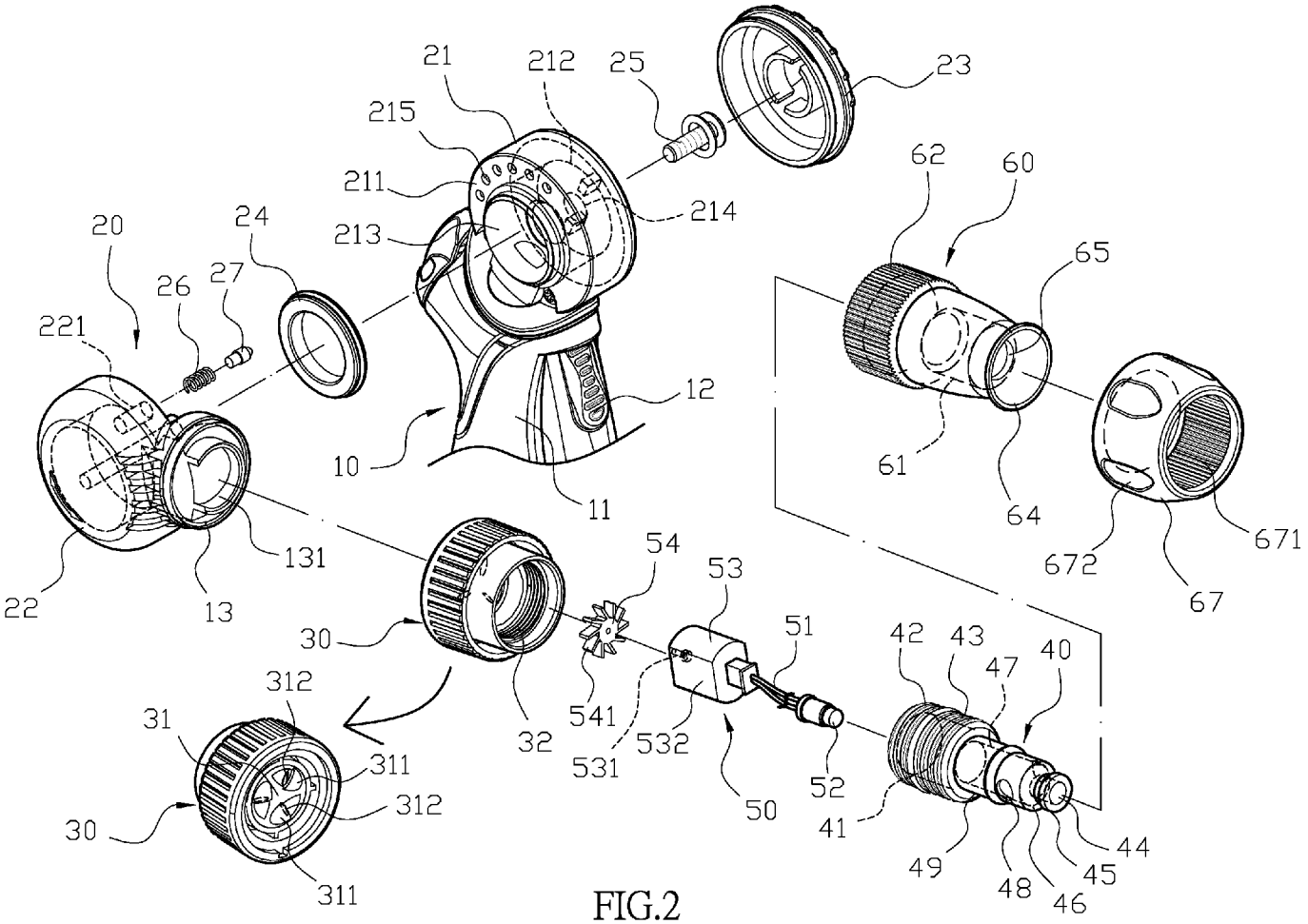
FIG. 2 illustrates an exploded view of the present invention.
Figure 3:
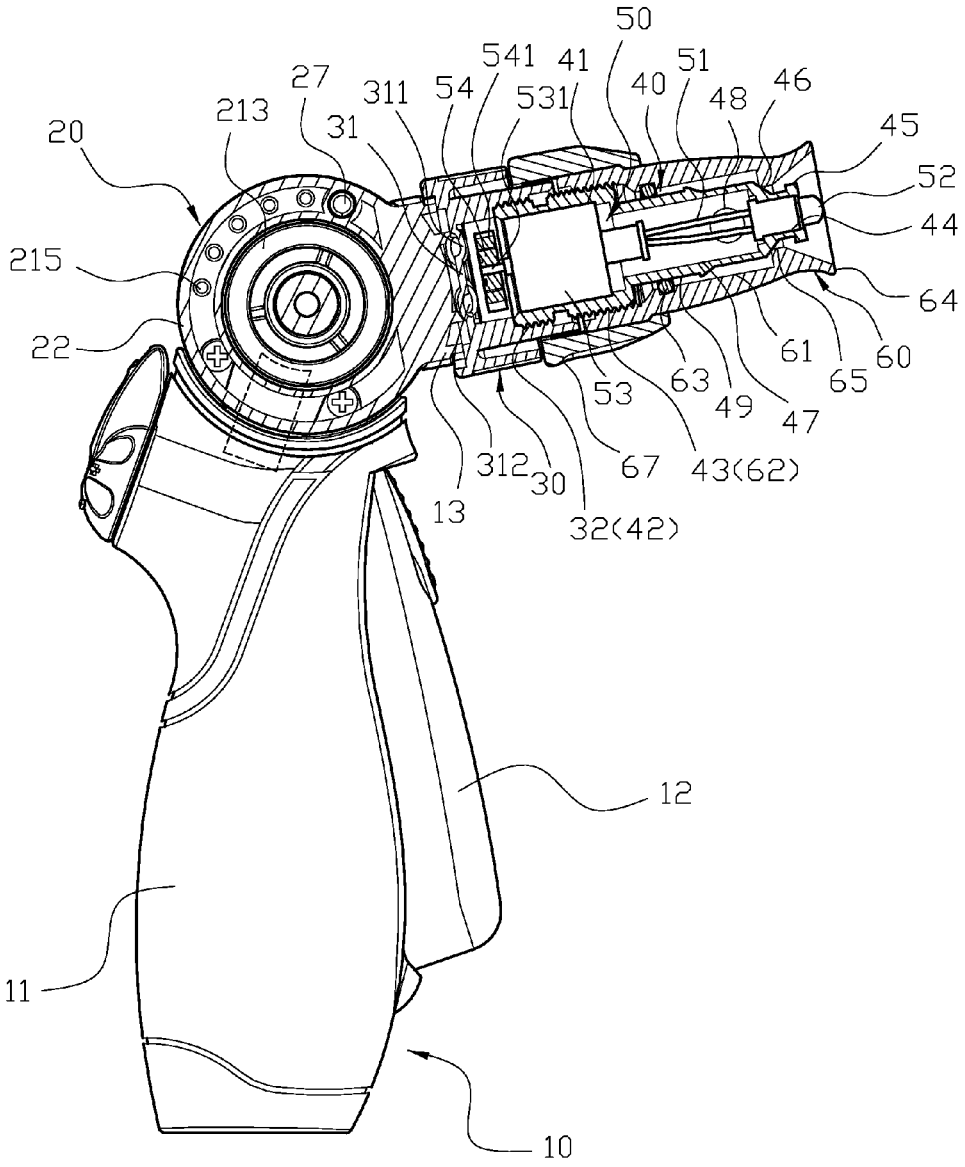
FIG. 3 illustrates a cross-sectional view of the present invention.
Figure 4:
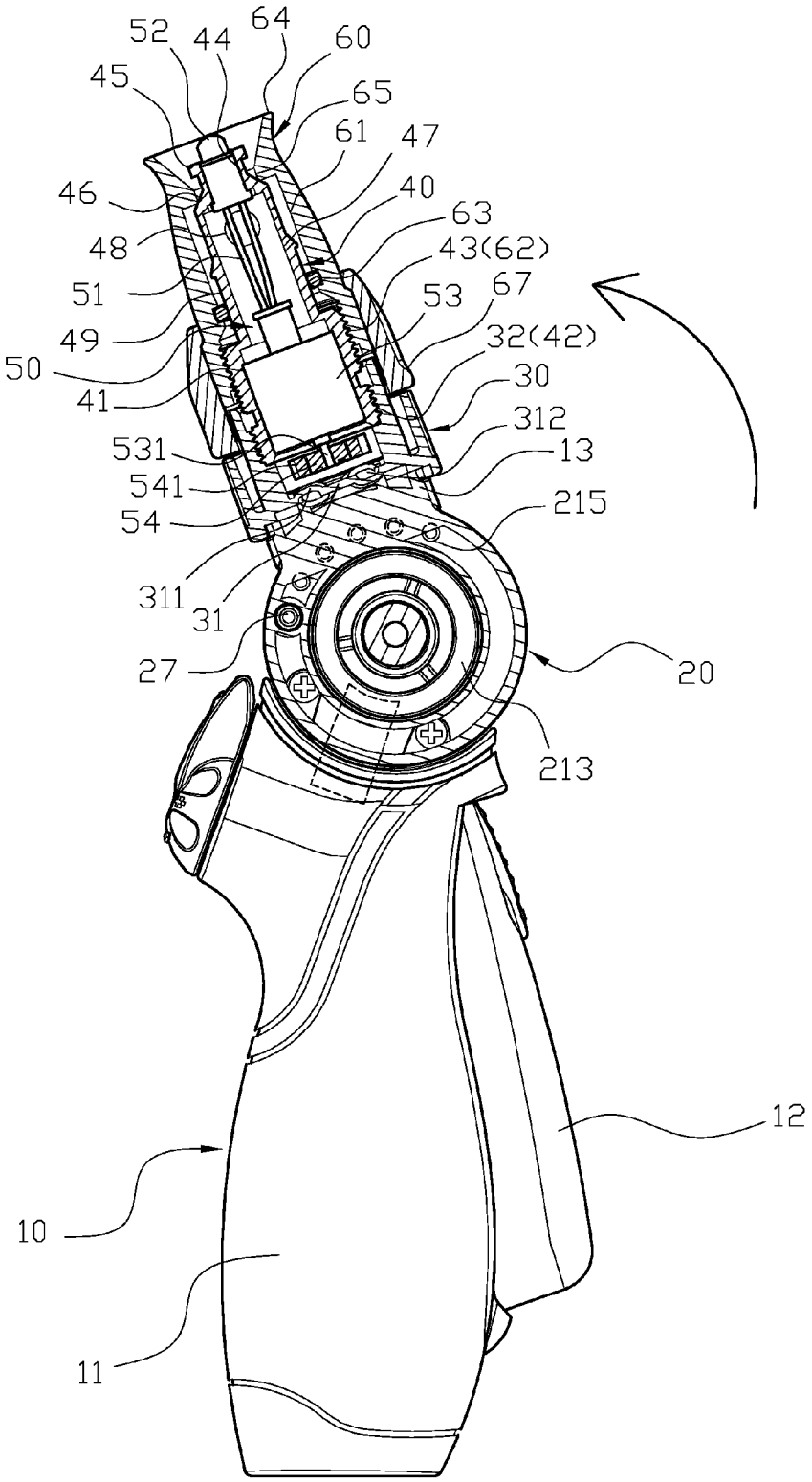
FIG. 4 illustrates a schematic view of elevation angle adjustment of the present invention.

Referring to FIGS. 1-3, a structure of LED illumination water spraying gun 1, it includes: a water spraying gun 10, a fixed sleeve 30, a nozzle 40, an illumination device 50, and an movable sleeve 60. A water spraying gun 10 has a handle 11 and set a press button 12 on the handle 11, one side of the handle 11 is connected with a coupling sleeve 13 by a wheel 20, which the coupling 13 set a water outlet hole 131 in the middle, it makes press button 12 can adjust water spray from water outlet hole 131, wherein the wheel 20 includes a fixed disc 21, a movable disc 22, and a side cover 23. The fixed disc 21 is integrally molded at water spraying gun's 10 handle 11, wherein fixed disc 21 forms correspondingly a first surface 211 and a second surface 212, the movable disc 22 can rotate and connect with first surface 211, and the side cover 23 is covered on fixed disc 21's second surface 212, coupling sleeve 13 is fixed at movable disc 22, the fixed disc 21 has a perforated hole 213 in the middle, and connect coupling sleeve's 13 water outlet hole 131 by through hole 213. There is a collar 24 between fixed disc 21 and movable disc 22, thereby, it has leak-proof effect between fixed disc 21 and movable disc 22, which the fixed disc 21's second surface 212 has a circular hole 214, and set a screw 25 on movable disc 22 by circular hole 214, thereby it forms fixed disc 21 can rotate and connect with movable disc 22. Making fixed disc 21 set plurality grooves 215 at first surface 211 and set a hole slot 221 at movable disc 22, setting a spring 26 and a lifter block 27 in the groove 221 in order, and using lifter block 27 collides at the groove 215 to form rotating position for fixed disc 21 and movable disc 22. Referring to FIG. 4, the movable disc 22 is set on fixed disc's 21 circular hole 214 by screw 25, it makes fixed disc's 21 perforated hole 213 can connect movable disc 22 to coupling sleeve's 13 water outlet hole 131, which the movable disc 22 can rotate around screw 25, moreover, it can change the relative angle between coupling sleeve 13 and water spraying gun 10, thereby, it has the function of adjusting elevation angle of water spray.

Figure 6:
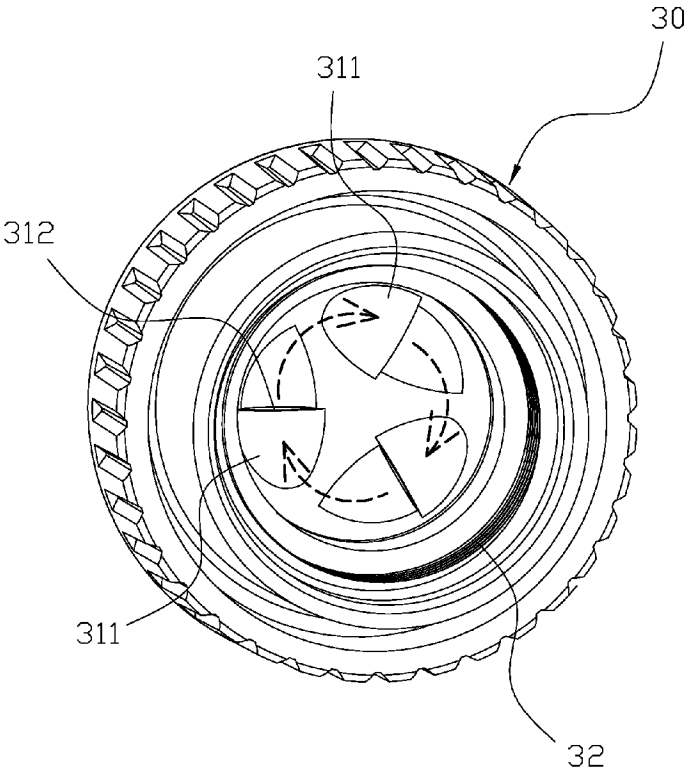
FIG. 6 illustrates another schematic view of fixed sleeve of the present invention.
Figure 5:
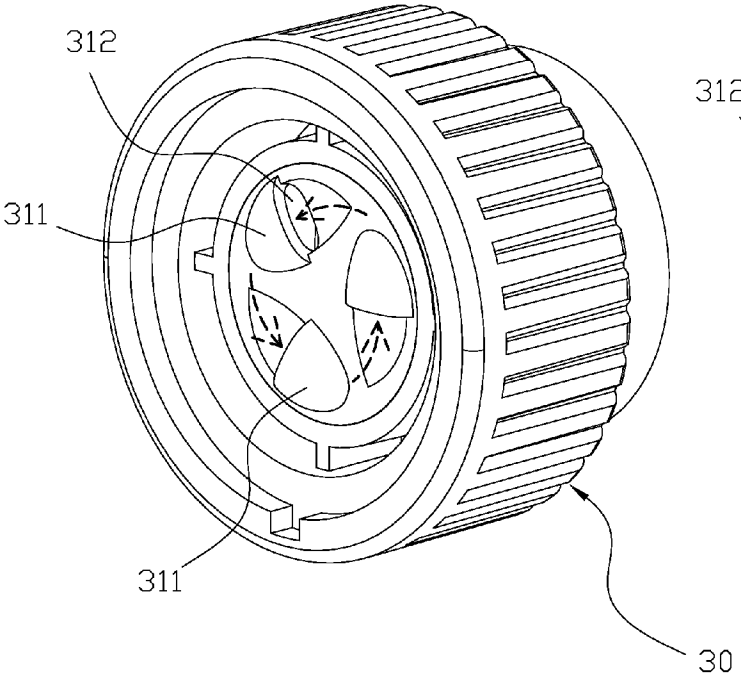
FIG. 5 illustrates a schematic view of fixed sleeve of the present invention.

A fixed sleeve 30 has a deflector 31 set on one side, referring to FIGS. 5-6, which the deflector 31 has plurality assembly convex parts 311 with opposite direction, and setting a deflector hole 312 between two assembly convex parts 311, and then the on the other side of fixed sleeve 30 has first thread 32 inside.

A nozzle 40 has a holding chamber 41 inside, on the one side and the outer of nozzle 40 at holding chamber 41 generates one second thread 42 and one third thread 43, and then second thread 42 fixes with fixed sleeve's 30 first thread 32, and then the other side of nozzle 40 has assembly hole 44 inside, which has a external expanding ring 45, and the nozzle 40 forms a cone toward ring part's 45 tapered part 46, and then the nozzle 40 has a channel 47 between holding chamber 41 and assembly hole 44, and the nozzle 40 transversely runs through channel 47 and form a side hole 48, wherein the nozzle 40 forms a inward-concave limited part 49 between third thread 43 and side hole 48.

Figure 7:
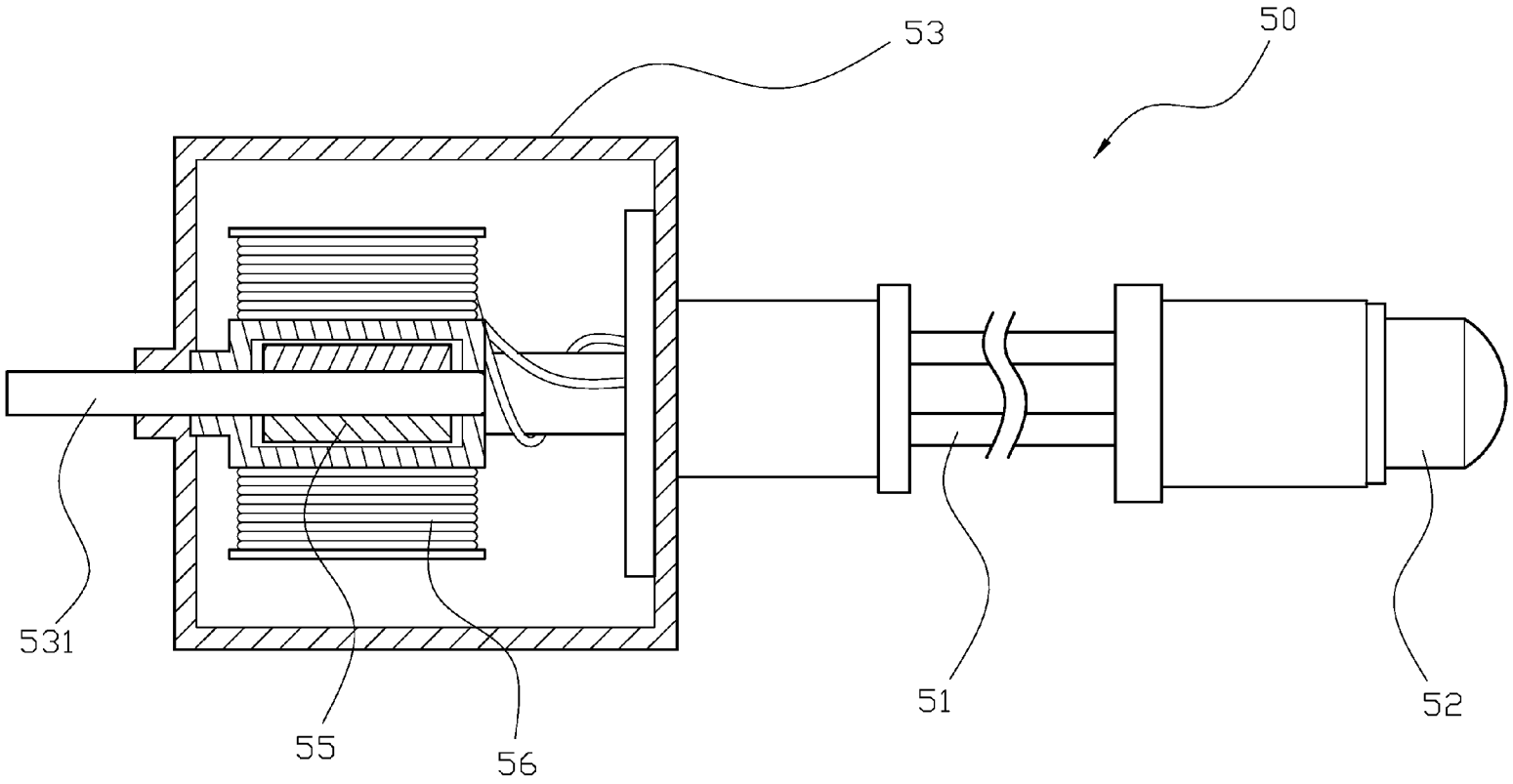
FIG. 7 illustrates the cross-sectional view of the LED lamp and power generating device of the present invention.

A illumination device 50 is connected with a LED lamp 52 and a power generating device 53 by wire 51, and extended by power generating device 53 has a shaft 531, which the LED lamp 52 runs through and sets on nozzle's 40 assembly hole 44, and sets power generating device 53 into nozzle's 40 holding chamber 41, which the power generating device 53 forms two planar parts 532, utilizing planar parts' 532 shrinking can make water flow through between holding chamber 41 and alternator 53, and then the shaft 531 extends to inside of the fixed sleeve 30 and connected to rotary disc 54 by shaft 531, which the rotary disc 54 forms radially plurality blades 541 outside. Referring to FIG. 7, power generating device 53 connects shaft 531 and forms a magnet rotor 55, wherein magnet rotor 55 sets plurality coil stators 56 outside the magnet rotor 55, utilizing rotary disc 54 to drive magnet rotor 55 rotating and coil stators 56 forming cutting magnetic line to generate electricity for LED lamp 52 illumination.

A movable sleeve 60 has a through hole 61 axially runs through, one inner side of through hole 61 forms a fourth thread 62, the movable sleeve 60 is set on nozzle 40 and set on nozzle's 40 third thread 43 by fourth thread 62, it makes nozzle's 40 side hole 48 and movable sleeve's 60 through hole 61 connected, the movable sleeve 50 has a sealing ring 63 inside the through hole 61, it can make sealing ring 63 collide the limited part 49 sets on nozzle 40, thereby it has leak-proof effect and can restrict the relative position of nozzle 40 and movable sleeve 60. The movable sleeve 60 forms a expanding guide ring 64 on the other side of the through hole 61, the guide ring 64 forms a adjusting hole 65, which its diameter is shorter than through hole 61, the adjusting hole 65 is between nozzle's 40 ring part 45 and tapered part 46. Wherein the movable sleeve 60 forms a outer gear ring 66 outside, and utilizes outer gear ring 66 combing ring body 67 with inner gear ring 671, there are plurality recesses 672 formed at ring body 67, utilizing ring body's 67 recesses 672 can provide using hand to apply force and making movable sleeve 60 simple to operate.

The combination of structure, referring to FIG. 1-3, the wheel's 20 movable disc 22 has setting a spring 26 and a lifter block 27 in the groove 221 in order, the fixed disc's 21 perforated hole 213 sets collar 24 around, and movable disc 22 covers fixed disc's 21 first surface 211, thereby generating the connection of perforated hole 213 and water outlet hole 131. There is a collar 24 between fixed disc 21 and movable disc 22, thereby, it has leak-proof effect between fixed disc 21 and movable disc 22, which the fixed disc 21's second surface 212 has a circular hole 214, and set a screw 25 on movable disc 22 by circular hole 214, using screw 24 pivot on movable disc 22 and covering fixed disc 21 by side cover's 23 second surface 212, it can combine wheel 20 and make movable disc's 22 handle 11 rotate around screw 25. The illumination device 50 is set inside the nozzle 40, setting LED lamp 52 at assembly hole 44, and fixing power generating device at holding chamber 41, wherein the power generating device's 53 shaft 531 sets a rotary disc 54, and then the nozzle 40 is set on fixed sleeve's 30 first thread 32 by second thread 42, it makes illumination device's 50 rotary disc 54 can set fixed sleeve 30 inside, and rotary disc's 54 blades 541 aim directly to front of deflector hole 312, and then setting movable sleeve 60 at nozzle 40, and using movable sleeve's 60 fourth thread 62 set on nozzle's 40 third thread 43, it can makes movable sleeve's 60 guide ring 64 can move between nozzle's 40 ring part 45 and tapered part 46, the ring body 67 can use inner gear ring 671 combine with movable sleeve's 60 outer gear ring 66, it can assist movable sleeve 60 applying force to rotate.

Figure 8:
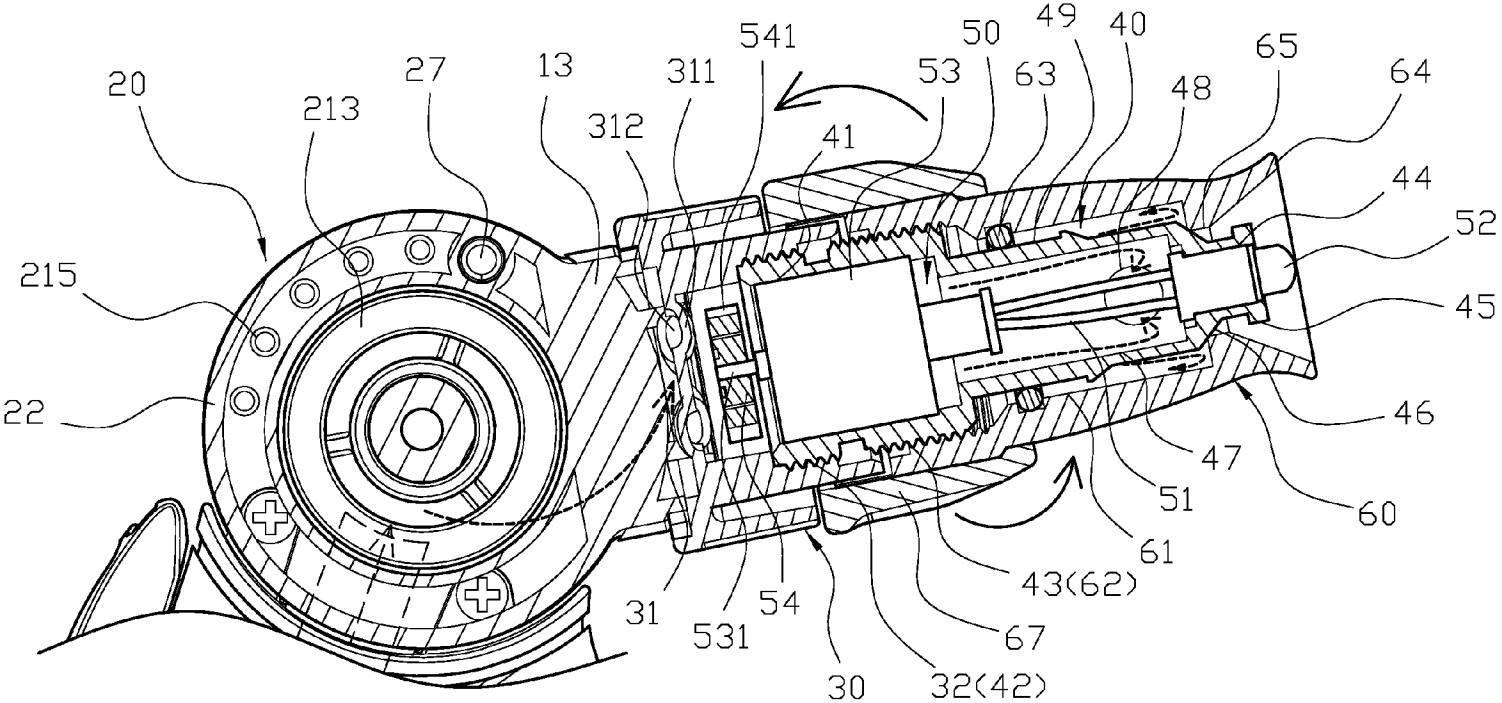
FIG. 8 illustrates a cross-sectional view of the present invention when in use.
Figure 9:
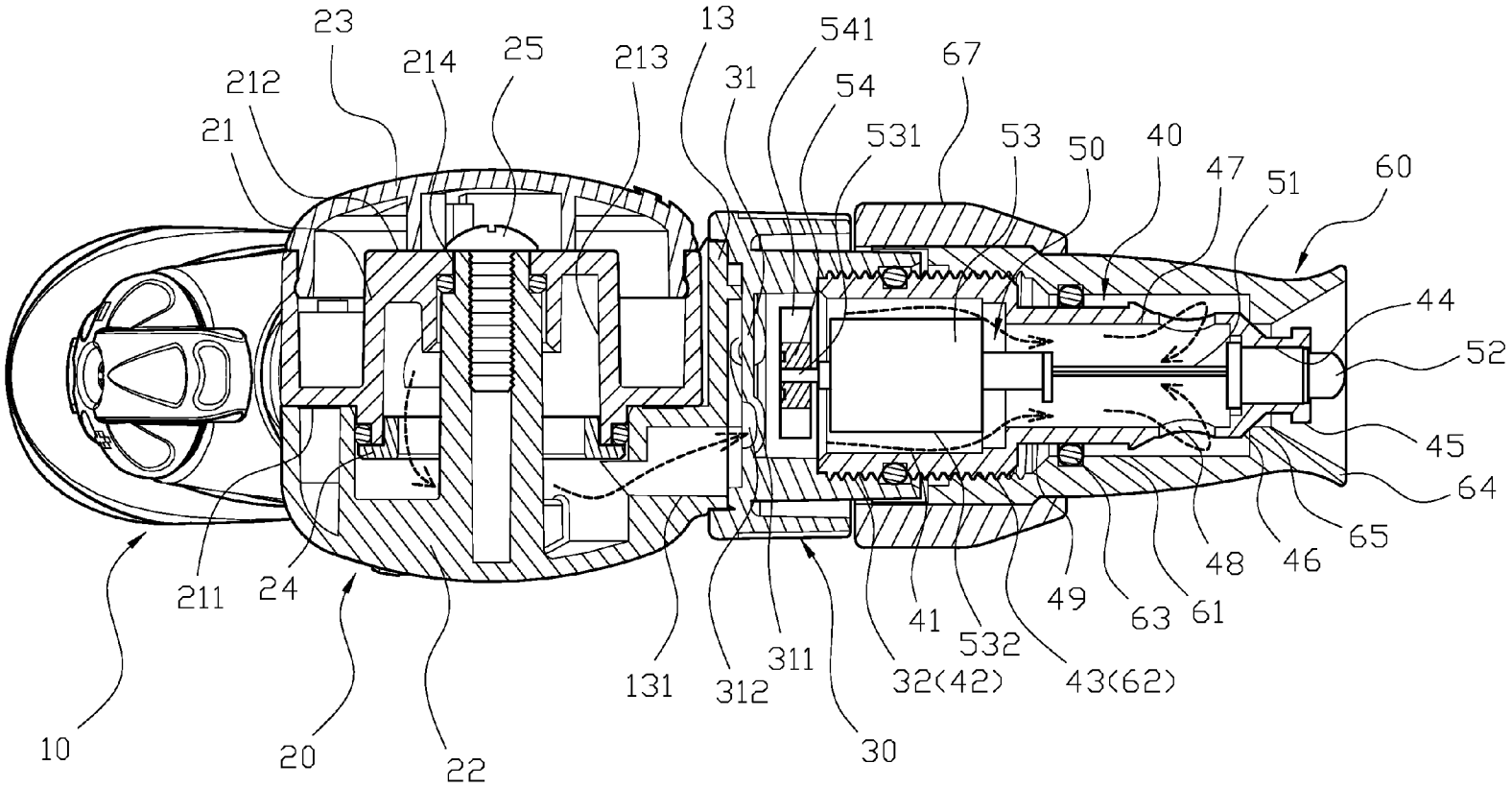
FIG. 9 illustrates another cross-sectional view of the present invention when in use.
Figure 10:
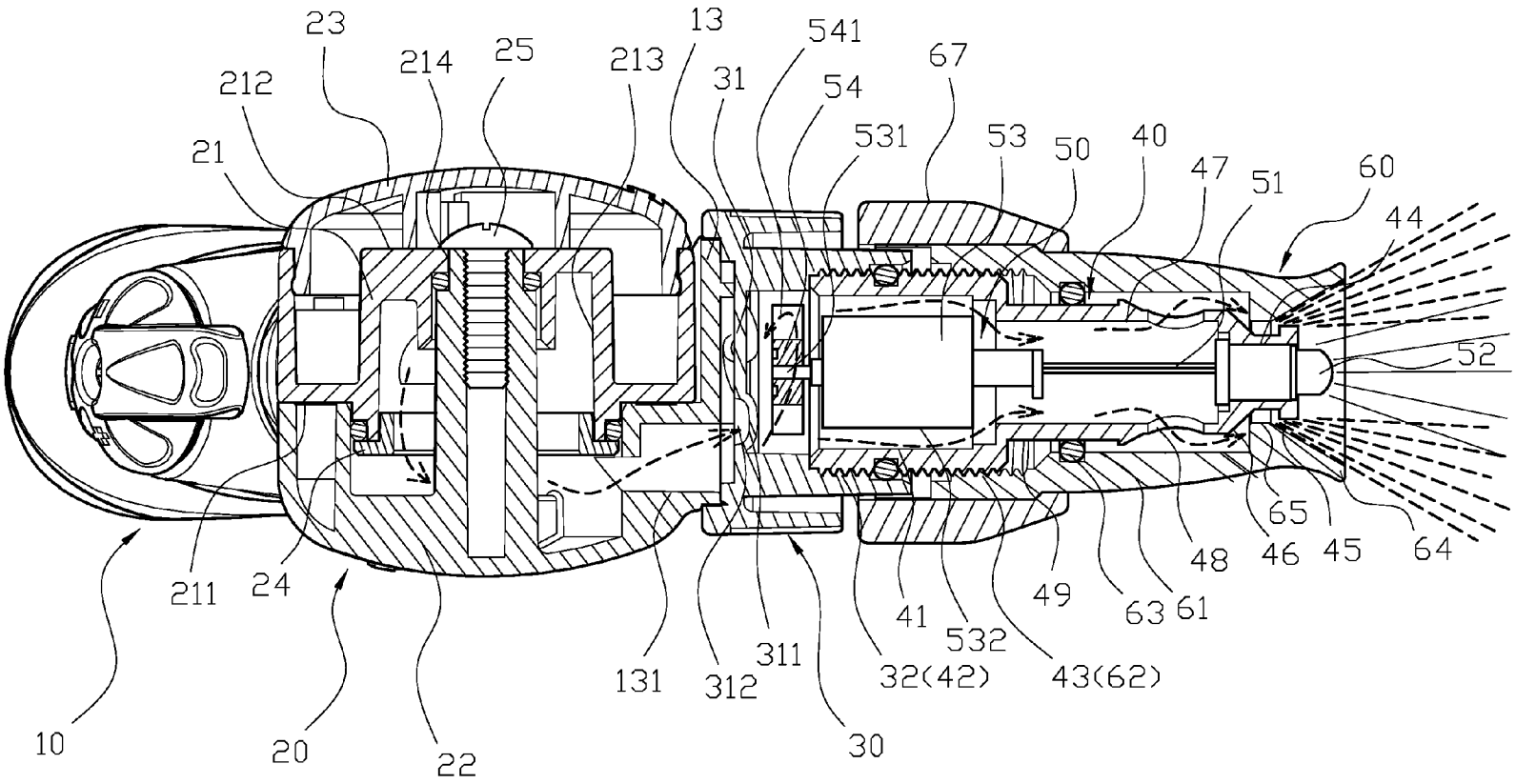
FIG. 10 illustrates a third cross-sectional view of the present invention when in use.
Figure 11:
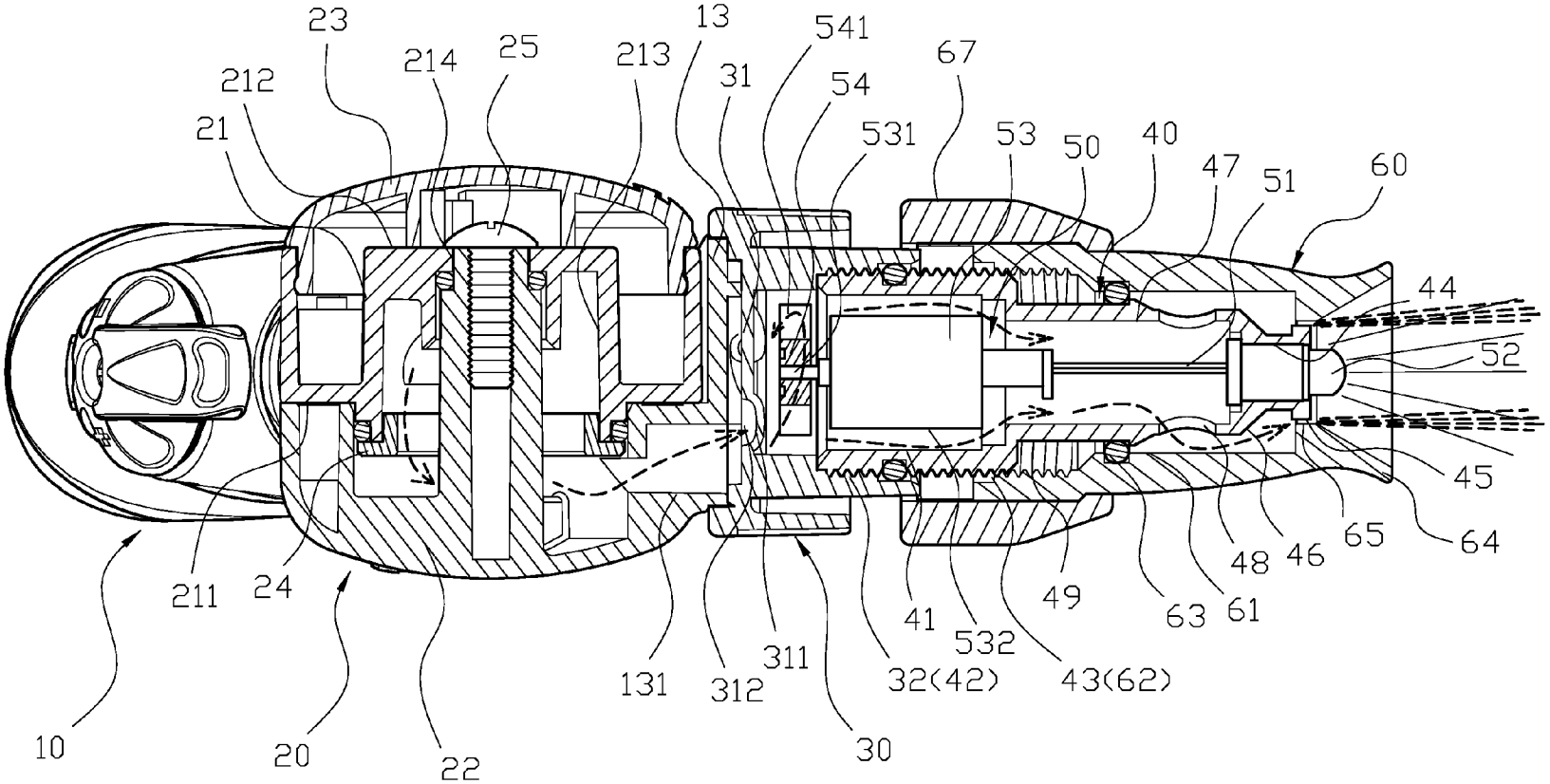
FIG. 11 illustrates a fourth cross-sectional view of the present invention when in use.
Figure 12:
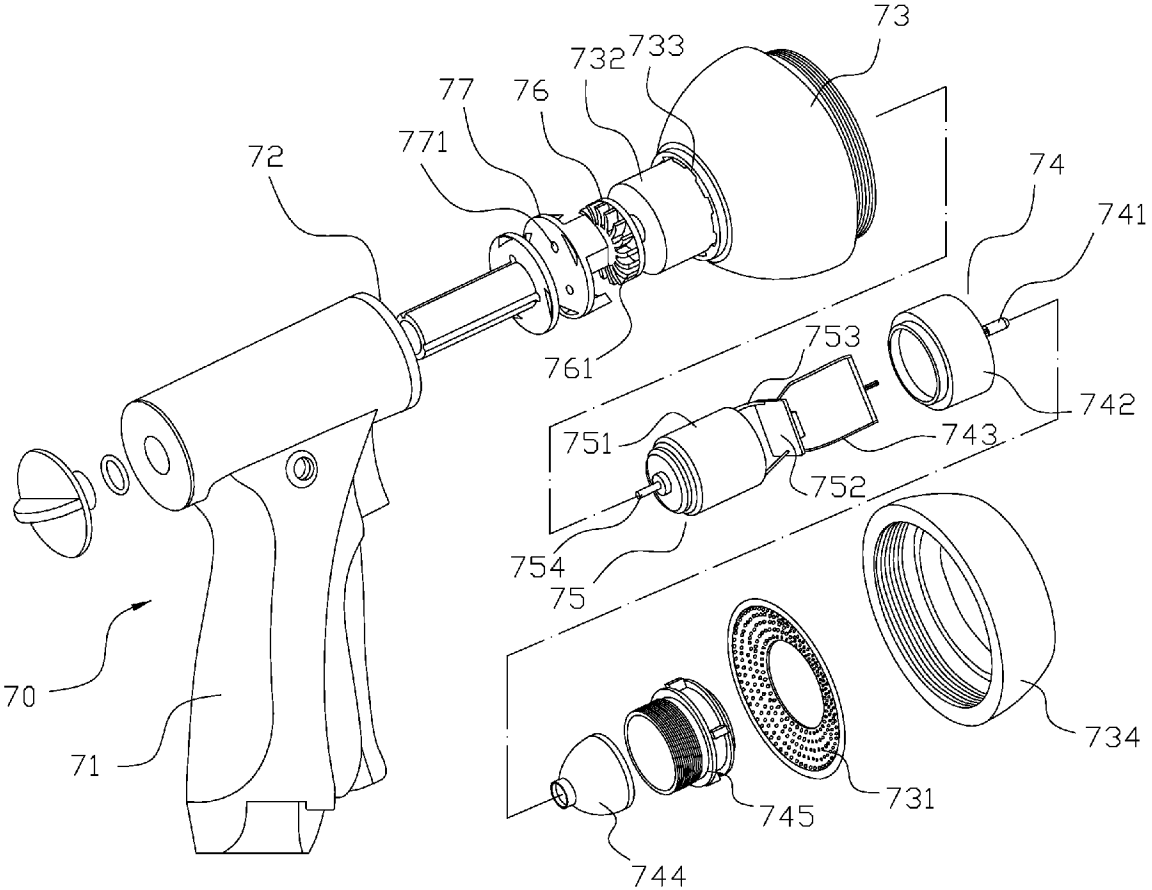
FIG.12 PRIOR ART
FIG. 12 illustrates a three-dimensional view of the prior art.
Figure 13:
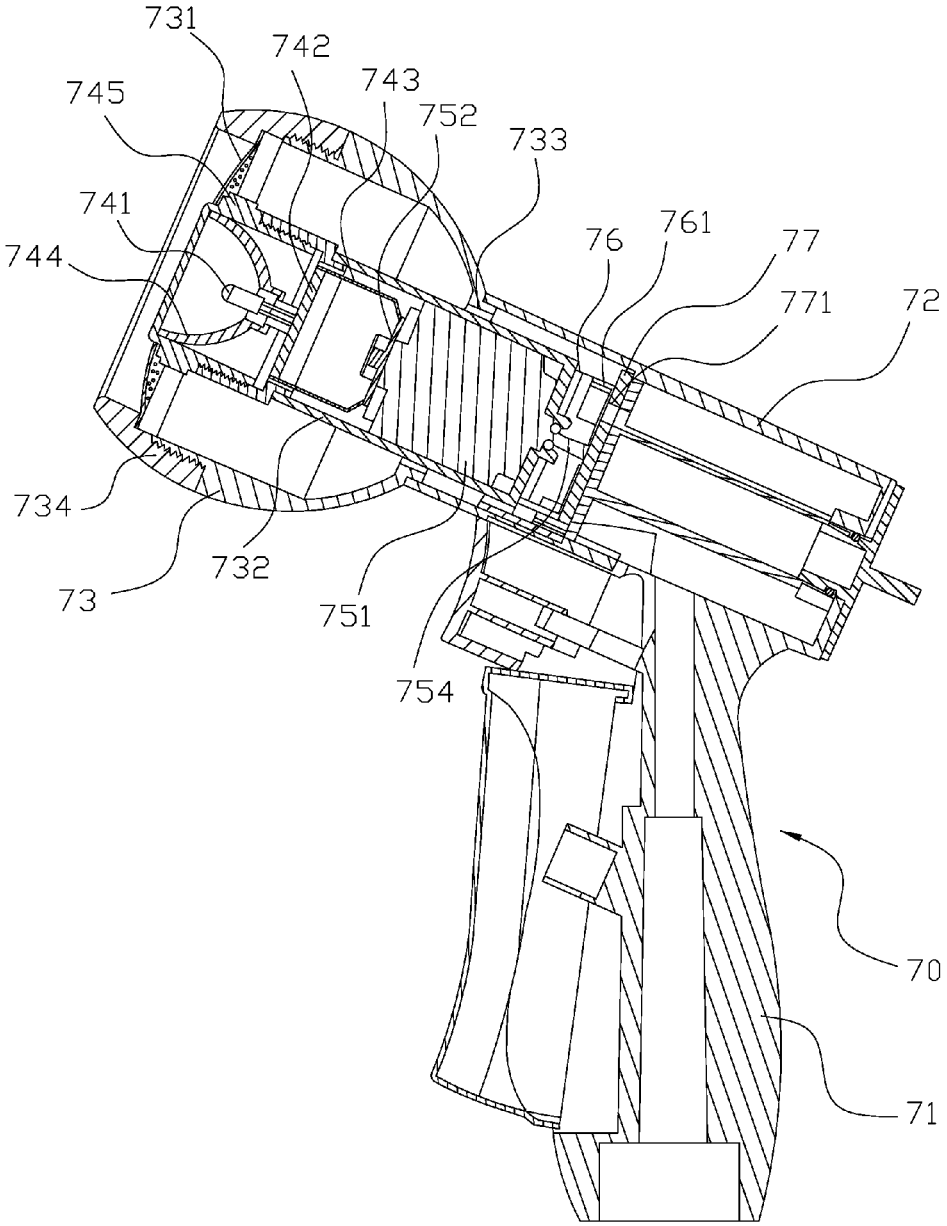
FIG.13 PRIOR ART
FIG. 13 illustrates a cross-sectional view of the prior art.

When in use, referring to FIGS. 2, 8 and 9, the water spraying gun 10 can control water flow on and off by press button 12, it can make water flow to coupling sleeve's 13 water outlet hole 131 by wheel 20, and then water flows from water outlet hole 131, passes through deflector's 21 deflector hole 312, and flows between nozzle's 40 holding chamber 41 and power generating device 53's planar part 532, and flows to channel 47, by this time, water can flows from side hole 48 to movable sleeve's 60 through hole 61, then water can spray directly from movable sleeve's 60 adjusting hole 65. Wherein, the movable sleeve's 60 can use fourth thread 62 to rotate and move to nozzle's 40 third thread 43, referring to FIG.9, movable sleeve's 60 adjusting hole 65 can collide nozzle's 40 tapered part 40, thereby preventing water flow does not spray. Also referring to FIG. 10, the movement of movable sleeve 60 makes adjusting hole 65 between tapered part 46 and ring part 45, utilizing the angle's difference between adjusting hole 65 and ring part 45, it makes water can flow along movable sleeve's 60 guide ring 64 and generate dispersive water spray. Also referring to FIG.11, the movement of movable sleeve 60 makes adjusting hole 65 overlap peripheral ring part 45, forming ring-shape gap between adjusting hole 65 and ring part 45 can make water flow spray directly and has columnar water spray, thereby can have the function of different types of water spray. Moreover, the water flows from deflector hole 312 and passes through deflector 31, since the deflector hole 32 is placed diagonal and water is affected by space of convex part 311, it can makes water rushes to the front of the rotary disc's 54 blade 541 and enhances driving force applying to rotary disc 54, which can increase rotary speed and torsion of rotary disc 54, at the same time, utilizing shaft 531 to drive magnet rotor 55 rotating and coil stators 56 forming cutting magnetic line to generate electricity and provide electricity by wire 51 for LED lamp 52 illumination, thereby according to above-mentioned structure, it can the function of changing water spray without interfere using LED lamp 52, which has the functions of LED lamp 52 illumination and changing water spray types.

According to above-mentioned structure, the present invention is advantageous because: (i) the nozzle 40 has assembly hole 44 to set LED lamp 52 on, and set power generating device 53 on holding chamber 41. It can let the power generating device's 53 rotary disc 54 on shaft 531 can be rotated by water flow, and let LED lamp 52 can generate illumination at movable sleeve's 60 guide ring 64, which movable sleeve's 60 fourth thread 62 lock on nozzle's 40 third thread 43, it makes water flow can flow through from nozzle's 40 side hole 48 to movable sleeve's 60 through hole 61, and utilizing adjusting hole 65 to spray the water. The movable sleeve 60 can move and make adjusting hole 65 move between nozzle's 40 ring part 45 and tapered part 46, which can change the water spray and the movement will not influence LED lamp 52, moreover, it has LED lamp 52 illumination and changing water spray function, and enhance practicability; (ii) the deflector 31 has plurality assembly convex parts 311 with opposite direction, and setting a deflector hole 312 between two assembly convex parts 311. When the water flow from deflector hole 312 to deflector 31, deflector hole 312 is placed diagonally and water is affected by space of convex part 311, it can makes water rushes to the front of the rotary disc's 54 blade and enhances driving force applying to rotary disc 54, which can increase rotary speed and torsion of rotary disc and enhance the stability of generating electricity; and (iii) the wheel 20 has fixed disc 21 and movable disc 22, which movable disc 22 is set on fixed disc's 21 circular hole 214 by screw 25, it makes movable disc's 22 perforated hole 213 connect to coupling sleeve's 13 water outlet hole 131, and the movable disc 22 can rotate around screw 25, moreover, it can change the relative angle between coupling sleeve 13 and water spraying gun 10, thereby, it has the function of adjusting elevation angle of water spray.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An LED-illuminated water spraying gun comprising:

a water spraying gun having a handle that includes a press button, and one side of the handle connected to a coupling sleeve by a wheel, a water outlet hole formed in a center portion of the coupling sleeve, the pressing button configured to adjust water spraying from the water outlet hole;

a fixed sleeve having a deflector disposed on one side, the deflector having a plurality of protruding portions corresponding to recessed portions, a deflector hole formed between two of the protruding portions, and a first thread formed on an inner portion of the fixed sleeve;

a nozzle having a receiving chamber inside one end of the nozzle, a second thread and a third thread formed at an outer edge of the nozzle, and the second thread engaging with the first thread; and an opposite end of the nozzle having an assembly hole inside, which has an expanding external ring, a cone formed toward the ring, a channel disposed between the receiving chamber and the assembly hole, and a side hole formed transversely through the channel;

an LED lamp connecting to a power generating device by wire, and a shaft extending from the power generating device; the LED lamp configured to secure on the assembly hole of the nozzle, and the power generating device disposed in the receiving chamber of the nozzle, wherein the power generating device has two planar parts, and water is configured to flow through between the receiving chamber and the power generating device, and the shaft extends to an inner portion of the fixed sleeve to connect to a rotary disc, and a plurality of blades are radially formed outside the rotary disc; and a movable sleeve having an axial through hole, a fourth thread formed at an inner portion of one end of the through hole, the movable sleeve disposed on the nozzle and the fourth thread and third thread engaged with each other to enable the communication of the side hole of the nozzle and the through hole of the movable sleeve; an expanding guide ring formed on the other end of the through hole and an adjusting hole that is smaller than the through hole formed at the guide ring, and the adjusting hole located between the cone the and ring part of the nozzle.

2. An LED-illuminated water spraying gun of claim 1, wherein the nozzle has an inward-concave restricting portion between the third thread and the side hole, and the movable sleeve has a sealing ring inside the through hole, and the sealing ring is disposed against the restricting portion to prevent the water from leaking.

3. An LED-illuminated water spraying gun of claim 1, wherein the wheel includes a fixed disc, a movable disc, and a side cover, and the fixed disc is integrally molded at the water spraying gun's handle, wherein the fixed disc has a first surface and a second surface, the movable disc is configured to rotate and connect with the first surface, and the side cover is covered on the fixed disc's second surface.

4. An LED-illuminated water spraying gun of claim 3, wherein the coupling sleeve is fixed on the movable disc, and a perforated hole is formed at a center portion of the fixed disc to connect with the coupling sleeve's water outlet hole, and a collar is disposed between the fixed disc and the movable disc.

5. An LED-illuminated water spraying gun of claim 3, wherein the fixed disc's second surface has a circular hole, and a screw is configured to pass through the circular hole and to be locked on the movable disc to connect the fixed disc and the movable disc.

* * * * *